United States Patent [19]

Yan

[11] 4,210,423

[45] Jul. 1, 1980

[54] SOLID FUEL USE IN SMALL FURNACES

[75] Inventor: Tsoung Y. Yan, Philadelphia, Pa.

[73] Assignee: Mobil Oil Corporation, New York, N.Y.

[21] Appl. No.: 27,628

[22] Filed: Apr. 6, 1979

[51] Int. Cl.[2] ..... C10L 9/00; C10L 9/08

[52] U.S. Cl. ..... 44/1 C; 44/6; 44/10 E

[58] Field of Search ..... 44/1 C, 6, 10 R, 10 D, 44/10 E

[56] References Cited

U.S. PATENT DOCUMENTS

| | | | |
|---|---|---|---|
| 2,069,074 | 1/1937 | Lum et al. | 44/10 R |
| 2,125,753 | 8/1938 | Spencer | 44/6 |
| 3,756,791 | 9/1973 | Mancke | 44/10 R |
| 4,148,613 | 4/1979 | Myers | 44/6 X |

FOREIGN PATENT DOCUMENTS

| | | | |
|---|---|---|---|
| 544987 | 8/1957 | Canada | 44/6 |
| 19928 | of 1909 | United Kingdom | 44/1 C |
| 503480 | 4/1939 | United Kingdom | 44/1 C |

*Primary Examiner*—Carl F. Dees

*Attorney, Agent, or Firm*—Charles A. Huggett; Raymond W. Barclay

[57] ABSTRACT

A method is described for preparing a solid fuel, in either powder or briquette form, for use in small furnaces.

The fuel has a relatively uniform heating value of 12,000–14,000 Btu per pound and is prepared by crushing and grinding coal to less than 200 mesh and drying and oxidizing the coal with a hot gas containing a trace of oxygen to a dried moisture content of 1–15%. Selected quantities of additives having approximately the same fineness are combined with the coals to minimize the effects of sulfur, to improve combustion and ash properties, to maintain fluidity of the solid fuel in powder form, to inhibit moisture pick-up, and to prevent auto-ignition and spontaneous combustion during storage of the solid fuel.

12 Claims, No Drawings

SOLID FUEL USE IN SMALL FURNACES

BACKGROUND OF THE INVENTION

1. Field of the Invention

This invention relates to the treatment of coal and particularly relates to admixture of coal with additives to improve its ignition, reduce its spontaneous combustibility, reduce its sulfur emission, minimize its pick-up of moisture and control its flow properties in finely divided form. More particularly, the invention relates to treatment of coal to provide a uniform and easily handled fuel, in powdered or in briquette form, for use in small furnaces.

2. Review of the Prior Art

At the present time, petroleum imports account for more than 40% of United States usage. At any time, this supply could be curtailed or eliminated by political or military action. Even if such an emergency situation does not develop, liquid hydrocarbon fuels could become increasingly scarce in view of government policies that affect domestic exploration, development, and refining. As such scarcity develops, stationary furnaces and power plants, including domestic and commercial furnaces for space heating and hot water, will tend to be fueled with solid fuels, particularly coals and other bio-mass such as wood products.

However, there are some important obstacles that will have to be overcome, such as the distribution of coal to households, the inconveniences encountered in burning coal as compared to gas and oil burning, and the environmental impact created by sulfur dioxide emission and by particulate emissions. Indeed, in preparing for an emergency situation, it is important to design a coal-based material and a coal-burning system that can be promptly put into use or which at least can be readily promoted as a substitute for liquid and gaseous fuels in domestic and small commercial applications. Such a coal-based material could be developed by suitable "refining" and blending of various coals with each other and with additives to make a composite material which is suitable for these special applications.

An important problem that can be expected to plague small domestic usage of coal is spontaneous combustion which is caused by slow oxidation of the coal without adequate opportunity for dissipating the resultant heat when the coal is being stored in piles and bins. In a given weight of coal, the rate of oxidation increases with the increase in exposed surface area, so that spontaneous combustion is more apt to occur in coal piles having an excessive amount of fines.

U.S. Pat. No. 1,545,620 discloses pulverized coal admixed with a hydrocarbon oil and limestone. U.S. Pat. No. 3,961,914 discloses a method for making coal resistant to spontaneous combustion by coating it with silicon dioxide. U.S. Pat. No. 3,985,516 discloses the coating of coal with a heavy liquid hydrocarbon material to prevent spontaneous combustion. U.S. Pat. No. 3,867,109 discloses a treatment process comprising adding heavy oils, having a specific range of viscosity, to powdered coal, heating the mixture at 100° F., and flashing it to 100° F. in order to improve its bunkerability or storage properties. U.S. Pat. No. 3,288,576 teaches the admixing of coal with an antioxidant to inhibit oxidation of the coal. U.S. Pat. No. 3,723,079 describes a process for stabilizing dried lignitic and sub-bituminous coal against spontaneous combustion which comprises treating the dried coal at about 175°-225° C. with 0.5-8% oxygen by weight and rehydrating the oxygen-treated coal with 1.5-6% by weight of water.

Other problems that have caused serious difficulties are the corrosion of furnaces and pollution of air by the sulfur in coals. Coals from the eastern United States particularly tend to be high in sulfur.

Efforts to remove or minimize the effects of sulfur have included the addition of sodium carbonate, as in U.S. Pat. No. 1,007,153, the addition of calcium sulfate or calcium phosphate as in U.S. Pat. No. 2,247,415, the addition of limestone or dolomite as in U.S. Pat. No. 3,640,016, mixing coal with water and heating the mixture in a non-oxidizing atmosphere at a temperature near the critical temperature of water and at a pressure high enough to maintain the water in a liquid state as in U.S. Pat. No. 3,660,054, admixing coal with manganous-amine complexes to reduce sulfur oxide and nitrogen oxides as in U.S. Pat. No. 3,443,916 and reacting coal with hydrogen to form hydrogen sulfide as in U.S. Pat. No. 3,909,212.

An additional problem that can be serious in any furnace is the formation of a slag that sticks to the furnace walls or bottom or the formation of an ash that will not agglomerate but is readily carried away with the combustion gases as fine particles into the atmosphere. The addition of sand and limestone have been proposed for correcting this condition, as in U.S. Pat. No. 1,150,839. The inhibition of slag formation is taught in U.S. Pat. No. 3,004,836 which discloses the addition of magnesium oxide and phosphate rock to certain coals.

Another pertinent factor in any proposed usage of coal for small furnaces is the variability of coal as to calorific value, chemical content, specific gravity, hardness, and size stability. Chemical content is commonly reported as a proximate analysis which is broken down into the following four items which must add up to 100%: moisture, volatile matter, fixed carbon, and ash. Chemical content when reported as an ultimate analysis is the summed percentages of carbon, hydrogen, sulfur, oxygen, nitrogen, and ash.

Specific gravity of pure coal varies from 1.25 to 1.70, generally increasing with rank or content of fixed carbon. Hardness or firmness depends upon the composition and location of the coal bed and may affect the grindability of coals. High volatile coals are more firm than low volatile coals. Size stability is the ability of coal to withstand breakage and further attrition, as would occur in handling, shipping, and delivery to the burner in the small furnace. This property is important because although a finely divided coal is desirable for proper handling and efficient burning, extreme dustiness is undesirable and may even be dangerous.

Ignition and combustion can also be problems when coal is employed in automatic-starting small furnaces, particularly during cold weather and when the furnaces are also cold. As a combustion improver, iron, manganese, and copper admixed with compounds of lead, cobalt, nickel, chronium, antimony, tin, and vanadium have been proposed in U.S. Pat. No. 3,348,932 to improve the burning properties of coals.

U.S. Pat. No. 3,332,755 also discloses fuel compositions of petroleum, coal, and coke which contain additives of aluminum, magnesium, and manganese. The additive mixture also contains a surfactant, a diluting oil (petroleum distillate), and glycol.

Coal is classified as to rank or the percentage of total carbon that occurs in complex, condensed, ring structures. The carbon content of coal supplies most of its heating value and is commonly reported as fixed carbon, the combustible residue left after driving off the volatile matter, although this material is not all carbon. In inverse proportion to rank is the content of volatile matter. Anthracite has the highest rank or proportion of fixed carbon, followed by bituminous, sub-bituminous, and lignite. Bituminous coal is classified as low-volatile bituminous, medium-volatile bituminous, and high-volatile bituminous.

Because such variations in coal as to chemical and physical properties can create serious problems in operating small furnaces which must be capable of operation without expert attendance, it is critically important for this invention that the various ranks and types of coals, after suitable size reduction, be blended to obtain a blend or average composition that will give a uniform heat content of about 12,000–14,000 Btu per pound, reproducible flow properties, optimum storage properties, and minimal slag, agglomeration, fly-ash content, and sulfur content.

SUMMARY OF THE INVENTION

It is accordingly an object of this invention to provide a solid fuel having a uniform chemical content and a uniform heat content of approximately 12,000–14,000 Btu per pound.

It is also an object to provide a solid fuel having a minimal sulfur content, enabling emissions upon burning thereof to pass accepted sulfur emission standards.

It is further an object to provide a solid fuel having flow properties permitting feeding thereof to small furnaces with conventional fluidized feeding equipment, e.g., pneumatic transmission.

It is another object to provide a solid fuel having minimal tendency to spontaneous combustion.

It is additionally an object to provide a solid fuel with adequate ash agglomerative properties to form a non-sticking slag and minimal fly ash so that fly-ash emissions meet standards therefor.

In accordance with these objectives and the principles of this invention, a solid fuel is herein provided that has (a) a uniform heat content of approximately 12,000–14,000 Btu per pound, (b) a uniform sulfur content that is balanced with a scavenger for $SO_2$ gas if necessary to enable stack gas from a small furnace to meet EPA emission standards for $SO_2$, (c) an ash that is soft, pliable and non-sticking and that does not form "clinkers" while burning, (d) no tendency during normal storage conditions to undergo spontaneous combustion or auto-ignition, (e) adequate flow properties so that the blend in powder form maintains fluidity and does not stick in the flow delivery line or in control devices, (f) insignificant tendency to pick up moisture during transportation or storage, (g) excellent ignition properties during cold weather starting in a coal furnace, and (h) excellent combustion properties for reducing carbon monoxide emission and soot formation and for improved heat recovery.

It should be understood that the term "coal" refers to any type of solid carbonaceous fuel, such as anthracite coal, bituminous coal, sub-bituminous coal, lignite, peat, coke, petroleum coke, and the like. It should also be understood that the sulfur in coal occurs in three forms: (1) pyritic sulfur in the form of pyrite or marcasite, (2) organic sulfur, and (3) sulfate sulfur.

The solid fuel is useful in the powdered form because it can be stored almost indefinitely, is readily transported to the consumer and conveyed on small-scale conveying and/or fluidizing equipment to the consumer's furnace, and is readily ignitable and burnable while meeting emission standards. This solid fuel is also useful when formed into standard-sized briquettes and mini-sized briquettes, whether by pressing or by extruding.

The solid fuel of this invention is in general prepared by pulverizing coal or blends thereof to a fine size, drying the pulverized coals in the presence of a controlled amount of oxygen to a selected moisture content, forming a coal blend by mixing the ground and dried coals to obtain a uniform selected Btu content of about 12,000–14,000 Btu per pound, and adding one or more additives having approximately the same particle size distribution and average particle size as the coal blend. The quantity of each additive is selected on the basis of calculated average values for the blended coal, based on analysis of moisture content, heating value, sulfur content, ash-softening temperature, and ash fluid temperature of each coal that is ground and admixed to form the coal blend.

Some of the additives have multiple utility in that they can simultaneously minimize moisture pick-up, inhibit spontaneous combustion and auto-ignition and enhance ignition properties of the coal blend. Other additives are capable of modifying the ash properties, inhibiting spontaneous combustion, and scavenging the $SO_2$ gas. Still other additives are suitable for maintaining the fluidity and inhibiting re-adsorption of moisture.

DESCRIPTION OF THE INVENTION

The solid fuel of this invention can be prepared from any coal or blend of coals, but low sulfur, low ash, high volatile A bituminous coal is clearly preferred. The nominal analyses of various coals suitable for use are set forth below.

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

The solid fuel is prepared in general by the following steps:

A. grinding individual coals to a fineness below 200 mesh. Ball mills or other types of conventional apparatus may be employed for pulverizing coarse coal in the preparation of the finely divided coal. The crushing and grinding of the coal can be accomplished either in a dry state or in the presence of a liquid such as water, if desired. The average particle diameter of the coal is below about 0.2 m.m.

B. drying the individual coals with a hot gas, preferably flue gas at 150°-800° F. which contains a trace amount of oxygen, i.e., less than about 2%, to a moisture content of 1-15% preferably 5 to 10%. The amount of oxygen is controlled to obtain 0.5-5% oxygen pick-up, particularly for caking coals;

C. analyzing the ground and oxidized coals for moisture content, ash-softening temperature, ash fluid temperature, heating value, and sulfur content; and blending the individual ground coals, preferably on a continuous basis, with each other to obtain the desired heating value of approximately 12,000-14,000 Btu per pound, while adding the following selected additives, ground to approximately the same size as the coals:

(1) an $SO_2$ scavenger, selected from the group consisting of limestone, lime dolomite, gypsum, calcium phosphate in the form of phosphate rock, apatite or phosphorite, bauxite, and mixtures thereof. The amount of scavenger employed ranges from 0.5 to 5 wt. % and will vary with the sulfur content of the particular coal. For coal having a sulfur content of about 2 wt. % or less about 0.5 to 2 wt. % of a scavenger, preferably dolomite, can be used. The amount of scavenger can be quite low since the indigenous ash retains much of the sulfur compounds, thereby preventing their emission to the air. Complete reaction with sulfur is not therefore required to meet the EPA emission standard of 80 micrograms of sulfur dioxide per cubic meter of air. Dolomite is the preferred scavenger and is employed in amounts ranging from 10 to 40 pounds per ton of coal.

(2) a combustion improver and ash modifier for reducing corrosion, fouling and ash slagging, selected from the group consisting of manganese dioxide, iron oxide, manganese nodules, sand and mixtures thereof. The amount of combustion improver employed will range from about 0.1 to 5 pounds, preferably 0.1 to 1.5 pounds, per ton of coal. Iron oxide is preferably in the form of bog iron, limonite, hemantite, magnetite or siderite.

In a preferred embodiment, manganese nodules are used as as the combustion improver. These nodules, as is known, are naturally occurring deposits of manganese, along with other metals, including iron, cobalt, nickel, and copper, found on the floor of bodies of water. They are found in abundance on the floors of oceans and lakes. For example, they are found in abundance on the floor of the Atlantic and Pacific Oceans and on the floor of Lake Michigan. The nodules are characterized by a large surface area, i.e., in excess of 150 square meters per gram. The nodules have a wide variety of shapes but most often those from the oceans look like potatoes. Those from the floor of bodies of fresh water, such as the floor of Lake Michigan, tend to be smaller in size. Their color varies from earthy black to brown depending upon their relative manganese and iron content. The nodules are porous and light, having an average specific gravity of about 2.4. Generally, they range from ⅛ to 9 inches in diameter but may extend up to considerably larger sizes approximating 4 feet in length and 3 feet in diameter and weighing as much as 1700 pounds. In addition to the metals mentioned above, the nodules contain silicon, aluminum, calcium and magnesium, and small amounts of molybdenum, zinc, lead, vanadium, and rare earth metals.

The manganese nodules should be cleaned to remove sand and other foreign matters, particularly sodium chloride which is detrimental to the equipment. This can be accomplished by washing and bleaching with water.

In addition to the above materials, other additives may be employed to impart one or more desired characteristics to the fuel composition. To improve ignition properties a middle distillate can be employed in an amount ranging from 1 to 10 pounds per ton of coal. The term "middle distillate" as used herein is applied to hydrocarbons in the so-called middle range of refining distillation, such as kerosene, light diesel oil, heavy diesel oil and heavy heating oil. Typical examples include #1 and #2 fuel oil (ASTM-D-396). 1D and 2D diesel fuel (ASTMD-975); 1 GT and 2 GT gas turbine fuel (ASTM-2880); and jet fuels such as Jet A or Jet A-1 (ASTM-D-1655). The use of an ignition improver not only facilitates stable combustion by providing combustible vapor upon heating, but further serves to control flow properties of the powdered coal by maintaining fluidity of the composition through feed lines and control devices. The middle distillate ignition improver also effectively prevents the adsorption of moisture by dried coals before or after blending and particularly during transportation or storage.

Other additives which can be employed serve to inhibit auto-ignition and spontaneous combustion which could result in fire and explosion. In order to prevent this hazard a water emulsion of a middle distillate with a surfactant can be sprayed over the coal during the coal pulverization or drying operation. Preferred surfactants are non-ionic surfactants containing oxyalkylene groups such as are described in U.S. Pat. Nos. 3,048,548; 3,442,242; 3,314,891; 3,595,968; 3,933,670 and the like. The surfactant can be employed effectively in a quantity below about 0.1 weight percent based on the total weight of the coal composition.

The coal compositions can be utilized in the form of a briquette by crushing the coal to below 10 mesh and uniformly blending the additives set forth in (1) and (2) above. The mixture is then heated and extruded through a die to obtain rods of desirable size and then broken into pellets. The heating step can be done directly with flue gas in the absence of oxygen or indirectly by contact with a hot surface at temperatures of about 200° C. At this temperature the coal becomes plastic and can be easily formed into a rod of desirable size. To increase surface area and aid combustion the rods may be shaped in the form of hollow tubes having one or more holes cut therein. Easily ignitable additives can be added to the combustion to improve ignition properties. For this purpose sawdust can be employed in the amount ranging from 0.5 to 10 weight percent based on the coal. To further improve ignition properties oxidants such as sodium nitrate may be added in the amount of 0.1 to 0.5 weight percent.

EXAMPLE 1

In the simplest form of practicing the process of this invention, 100 pounds of a high volatile A bituminous coal from the McAlaster field in Oklahoma, having low sulfur and low ash, is ground in a C-E Raymond Roller Mill to below 200 mesh while flue gas is blown therethrough, the flue gas having an oxygen content of about 1% and a temperature of 250° F. The as-received coal has a moisture content of 2.0% and a heating value of 13,500 Btu per pound. Its ash-softening temperature is 2230° F. Its ash content is 4.5% and its sulfur content is 0.75%. Two weight % of powdered dolomite and 0.005 pounds of manganese nodules are added and mixed with the coal to form a solid fuel. It can be burned in a furnace used to heat a hot water system for a 50-unit apartment building. The $SO_2$ emission is satisfactory. A small amount of kerosene can be added to the coal to improve ignition properties.

EXAMPLE 2

Two hundred pounds of a high-volatile A bituminous coal from the Elkhorn mining district of Kentucky, having a moisture content of 3.4%, volatile matter of 36.8%, fixed carbon of 59.9%, ash of 4.0%, sulfur of 0.8%, and a heating value of 14,000 Btu per pound, with an ash-softening temperature of 2425° F., are pulverized in the same Raymond Mill to below about 200 mesh. Two hundred pounds of a low-volatile bituminous coal from the Northern Coal Field of Pennsylvania, having a moisture content of 3.0%, volatile matter of 6.1%, fixed carbon of 82.0%, ash of 8.9%, sulfur of 0.7%, and heating value of 13,000 Btu per pound with an ash-softening temperature of 3010° F., are similarly pulverized in the Raymond Mill to below about 200 mesh. The coals are fed to a twin-vee tumbler mixer which is heated by an internal heating element to raise the temperature of the coals to about 50° C. Mixing continues while flue gas having an oxygen content of about 0.5% is blown therethrough and two pounds of powdered limestone and 0.05 pound of powdered manganese nodules, both ground to less than 200 mesh, are added. Mixing is continued until the coal has picked up about 2.5% of oxygen. After the heating unit is disconnected, mixing is continued until the coal blend has cooled to a temperature below about 40° C. Using a hand sprayer, 0.05 pound of kerosene is then added to the blend, and the mixing operation is continued until all the kerosene is uniformly distributed. The solid fuel can be used in a small furnace to heat a four-bedroom home.

EXAMPLE 3

Two hundred pounds of a high-volatile B bituminous coal from the Mary Lee mining district of Alabama, having a moisture content of 2.6%, volatile matter of 28.1%, fixed carbon of 58.4%, ash of 11.0%, and sulfur of 1.0%, with a heating value of 13,300 Btu per pound and an ash-softening temperature of 2850° F., is pulverized to less than 200 mesh in the Raymond Mill and added to the tumbler mixer. One hundred pounds of a high-volatile A bituminous coal from the Franklin mining district of Illinois, having a moisture content of 10.0%, volatile matter of 32.8%, fixed carbon of 49.3%, ash of 7.9%, and sulfur of 1.0% with a heating value of 11,860 Btu per pound and an ash-softening temperature of 2375° F., is similarly pulverized in the Raymond Mill and added to the tumbler mixer. Another one hundred pounds of high-volatile A bituminous coal from the Springfield mining district of Illinois, having a moisture content of 13.1%, volatile matter of 36.5%, fixed carbon of 41.1%, ash of 9.3%, and sulfur of 3.8%, with a heating value of 10,940 Btu per pound and an ash-softening temperature of 2115° F., is similarly pulverized in the Raymond Mill and added to the tumbler mixer.

With the heating unit in operation, dry flue gas having an oxygen content of about 1.5% is passed into the tumbler mixer while three pounds of slaked lime, pulverized to the same fineness as the coal, and 0.1 pound of powdered manganese nodules from Green Bay, having manganese content of 40.4%, iron content of 31.3%, silicon dioxide content of 37.6% and aluminum oxide content of 4.4%, are added. When the coal oxidizes to an oxygen content of 3.2% and the moisture is reduced to 5.0%, heating is discontinued, but mixing is continued until the coal blend cools to about 40° C. About 0.7 pound of distillate fuel is then sprayed with a hand sprayer into the coal blend to form the final solid fuel.

This solid fuel can be delivered into a one-inch pipe through which air is blown under slight pressure. The solid fuel and air form a fluidized mixture which is conveyed to a furnace. The air-solid fuel mixture enters the furnace tangentially and is satisfactorily burned with no clinker problem and minimal fly ash emission.

EXAMPLE 4

One hundred pounds of high-volatile A bituminous coal from Fayette County, Pa., having a moisture content of 4%, 28% volatile matter, 60% fixed carbon, 8% ash and 1.0% sulfur is ground in the Raymond Mill to below 200 mesh and added to the tumbler mixer. The coal has an ash content of 8% and a heating value of 15,520 Btu per pound. One hundred and fifty pounds of high-volatile A bituminous coal from Union County in western Kentucky having a moisture content of 9%, volatile matter of 37%, fixed carbon of 45%, ash of 9%, and sulfur content of 4% with a heating value of 14,600 Btu per pound, is similarly ground in the Raymond Mill and added to the tumbler mixer. One hundred and fifty pounds of coal from Marion County, Iowa, having a moisture content of 7%, volatile matter of 39%, fixed carbon of 47% and sulfur content of 5%, with a heat value of 10,200 Btu per pound, is also ground in the same Raymond Mill to below 200 mesh and similarly added to the tumbler mixer.

Flue gas at 220° F. and having about 2% oxygen is fed to the tumbler mixer which is rotated with its heating unit in operation while 2.5 pounds of bauxite (ground to the same size as the coals), 1.5 pounds of powdered manganese nodules, and approximately one gallon of a non-ionic surfactant solution of heavy diesel oil are added. When the coal oxidizes to an oxidation content of about 4%, the flue gas is disconnected and mixing is continued until the solid fuel has cooled to about 40° C. The solid fuel is then dumped into a 450-pound drum and stored for subsequent use.

EXAMPLE 5

Two hundred pounds of high-volatile A bituminous coal from the Fulton mining district in Illinois, having a moisture content of 16.3%, volatile matter of 35.5%, fixed carbon of 35.0%, and sulfur content of 2.9%, with a heating value of 10,220 Btu per pound and an ash-softening temperature of 1930° F., is ground in the Raymond Ball Mill and added to the tumbler mixer. Two hundred pounds of medium-volatile bituminous coal from the lower Freeport mining district in Cambria County, Pa., having a moisture content of 2.9%, a volatile matter of 22.5%, fixed carbon of 67.1%, ash of 7.7%, and sulfur of 1.7%, with a heating value of 15,600 Btu per pound and an ash-softening temperature of 2465° F., is also ground in the Raymond Mill and added to the tumbler mixer. In each instance the coals were ground to less than 200 mesh.

The mixer is operated with flue gas having a temperature of about 300° F. and oxygen content of about 0.5%. Simultaneously, about four pounds of sawdust, 3.5 pounds of ground phosphate rock, and 1.0 pound of manganese nodules are added to the coals being blended. When the oxidation of the coal has proceeded to about 3% and the flow properties appear adequate, the flue gas is disconnected while mixing is continued until the solid fuel has cooled to slightly below 40° C. The solid fuel is then dumped into a cart and moved to an extruding unit into which it is dumped. The solid fuel is heated to its softening point, about 200° C., and is extruded through a die to obtain a rod of about ½ inch diameter. The extruding unit is electrically heated so that the solid fuel is indirectly heated by contact with the hot surfaces of the extrusion unit. The extruding unit is operated to produce about 100 pounds of solid rod and about 300 pounds of rod having three longitudinally disposed holes therein by changing the dies. Both types of rod are automatically cut into lengths of about one inch as the extruding proceeds. The hollow rods ignite automatically in a cold furnace and burn quite satisfactorily.

EXAMPLE 6

Two hundred pounds of a low-volatile bituminous coal from Franklin County in Arkansas, having a volatile matter of 14%, fixed carbon of 76%, and a heating value of 13,900 Btu per pound with a moisture content of 3% and an ash content of 7%, are crushed to pass a 10-mesh sieve. Two hundred pounds of high-volatile C bituminous coal from the Bear Creek mining district near Carbon, Mont., having a moisture content of 9%, a volatile matter of 36%, fixed carbon of 46%, ash of 9%, and sulfur of 2%, with a heating value of 10,700 Btu per pound and an ash-softening temperature of 2050° F., is similarly crushed to pass a 10-mesh sieve. The crushed coals are blended in the tumbler mixer while seven pounds of powdered gypsum, one pound of powdered manganese nodules, and about ¼ gallon of heavy heating oil are added thereto. After a thorough mixing, the mixture is delivered to an extruding unit wherein it is heated to about 200° C. and extruded through plastic dies to form solid rods of about 3/16 inch diameter. The rods are broken into random lengths of about ½ inch as they are cooled and packaged in 50-pound bags. The rods burn with no difficulty and produce negligible emission and fly ash.

What is claimed is:

1. A method for producing a solid fuel for small furnaces in powder form or in briquette form which has: (a) a uniform heat content of approximately 12,000–14,000 Btu per pound, (b) a sulfur content that is balanced with a scavenger for $SO_2$ gas to enable stack gases from said small furnaces to meet EPA emission standards for $SO_2$, (c) an ash that is soft, pliable, and non-sticking and that does not form "clinkers" while burning, (d) no tendency during normal storage conditions to undergo spontaneous combustion or auto-ignition, (e) adequate flow properties so that said fuel in powder form maintains fluidity and does not stick in the delivery system therefor, (f) insignificant tendency to pick up moisture during transportation or storage, (g) excellent ignition properties during cold weather starting in a cold furnace, and (h) excellent combustion properties for reducing carbon monoxide emission and soot formation and for improved heat recovery, which comprises the following steps:

A. grinding a coal or mixture of coals having a heating value of about 12,000 to 14,000 Btu to a fineness below 200 mesh;

B. drying the coal or coals with a hot gas, which is at 150°–800° F. and contains a trace amount of oxygen, to a dried moisture content of 1–15%;

C. blending the coal or coals with at least one additive selected from each group set forth below;

(1) an $SO_2$ scavenger for minimizing the effects of sulfur in said coal selected from the group consisting of limestone, lime, dolomite, gypsum, calcium phosphate, bauxite, and mixtures thereof, (2) a combustion improver and ash modifier for imparting burning properties and for reducing corrosion, fouling, and ash slagging, selected from the group consisting of manganese dioxide, iron oxide, and manganese nodules.

2. The method of claim 1 wherein an ignition improver selected from the group consisting of kerosene, light diesel oil, heavy diesel oil, and heavy heating oil is added to the fuel.

3. The method of claim 1 wherein a flow control additive for maintaining the fluidity of the solid fuel selected from the group consisting of a middle distillate and surfactant solutions thereof is added to the solid fuel.

4. The method of claim 1 wherein a moisture inhibitor selected from the group consisting of a middle distillate and a water emulsion thereof as a surfactant solution is added to the fuel.

5. The method of claim 1 wherein an auto-ignition and spontaneous combustion inhibitor selected from the group consisting of slaked lime, a middle distillate, and a water emulsion of said middle distillate as a surfactant solution is added to the fuel.

6. The method of claim 1 wherein said grinding, drying, and blending steps are continuous.

7. The method of claim 6 wherein said grinding, drying and blending steps are simultaneous.

8. The method of claim 7 wherein said hot gas is flue gas.

9. The method of claim 8 wherein the coal is selected from the group consisting of anthracite coal, bituminous coal, sub-bituminous coal, lignite, peat, coke, and petroleum coke.

10. The solid fuel produced by the method of claim 1.

11. The solid fuel produced by the method of claim 9.

12. The solid fuel of claim 9 which is utilizable in said powder form.

* * * * *

UNITED STATES PATENT AND TRADEMARK OFFICE

CERTIFICATE OF CORRECTION

PATENT NO. : 4,210,423

DATED : July 1, 1980

INVENTOR(S) : Tsoung Y. Yan

It is certified that error appears in the above-identified patent and that said Letters Patent are hereby corrected as shown below:

In the Title: After "FUEL" insert --FOR--.

Column 10, line 9, delete "fineness below 200 mesh;" and insert --fine size--.

Add:

"Claim 13. The method of claim 1 wherein the coal is ground to a fineness below 200 mesh."

On the title page, below the Abstract, "12 Claims" should read -- 13 Claims --.

Signed and Sealed this

*Eleventh* Day of *November 1980*

[SEAL]

*Attest:*

SIDNEY A. DIAMOND

*Attesting Officer*

*Commissioner of Patents and Trademarks*